US005194141A

United States Patent [19]

Suganuma et al.

[11] Patent Number: 5,194,141

[45] Date of Patent: Mar. 16, 1993

[54] METHOD FOR ELECTROLYTIC TIN PLATING OF STEEL PLATE

[75] Inventors: Yoshiaki Suganuma, Kanagawa; Yasuo Nakajima, Tokyo; Yukiei Matsumoto, Kanagawa, all of Japan

[73] Assignee: Permelec Electrode Ltd., Kanagawa, Japan

[21] Appl. No.: 691,292

[22] Filed: Apr. 25, 1991

[30] Foreign Application Priority Data

Apr. 27, 1990 [JP] Japan ..... 2-110228

[51] Int. Cl.[5] ..... C25D 3/30; C25D 17/10

[52] U.S. Cl. ..... 205/300; 205/301; 204/282; 204/296

[58] Field of Search ..... 204/54.1, 44.4, 282, 204/296, 290 F; 205/300, 301

[56] References Cited

U.S. PATENT DOCUMENTS 4,181,580 1/1980 Kitayama et al. ..... 204/54.1
4,229,277 10/1980 Speecht ..... 204/282
4,343,690 8/1982 de Nora ..... 204/282
4,711,709 12/1987 Inoue ..... 204/282

FOREIGN PATENT DOCUMENTS 508445 12/1954 Canada .
55-119188 9/1980 Japan .
56-152996 11/1981 Japan .

OTHER PUBLICATIONS

Chemical Abstracts, vol. 102, No. 22, Jun. 1985, p. 585, Abstract No. 194010w.

*Primary Examiner*—John Niebling
*Assistant Examiner*—Brian M. Bolam
*Attorney, Agent, or Firm*—Sughrue, Mion, Zinn, Macpeak & Seas

[57] ABSTRACT

A method for the electrolytic pin plating of a steel plate using an insoluble anode, said anode being an insoluble electrode comprising a corrosion-resistant metal substrate having provided thereon a coating containing a platinum group metal or an oxide thereof, said anode being enclosed with a diaphragm.

4 Claims, No Drawings

METHOD FOR ELECTROLYTIC TIN PLATING OF STEEL PLATE

FIELD OF THE INVENTION

The present invention relates to a method for the electrolytic tin plating of a steel plate using an insoluble electrode.

BACKGROUND OF THE INVENTION

Tin-plated steel plates have heretofore been used as a container material, etc., and in the commercial production thereof, the ferro-stann method, which is acid-bath plating technique, is extensively used.

The ferro-stann method uses a tin phenolsulfonate bath as the tin-plating bath. Although soluble tin electrodes were conventionally used as the anode, methods using insoluble electrodes, such as a platinum-plated titanium electrode, in place of the soluble electrodes, have recently been developed and come to be placed into practical industrial use.

However, this plating method using such insoluble anodes is still incomplete and should be improved further in some respects, although the method is very effective in eliminating the drawbacks accompanying the use of soluble electrodes. That is, there is a problem in that the consumed amount of phenolsulfonic acid (PSA), ethoxy-α-naphtholsulfonic acid (ENSA), etc., which are ingredients contained in the plating bath, is still considerably large, resulting in an insufficient reduction in the used amount thereof. In addition, there has been found to exist another problem, in that even when platinum-plated titanium electrodes are used, tin oxide sludges are formed in the plating bath, and this raises concerns that accumulation of such sludges in the bath or deposition thereof on the electrode surface may impede the plating operation and impair the quality of the tin-plated steel plates being produced.

SUMMARY OF THE INVENTION

An object of the present invention is to provide an excellent method for the electrolytic tin plating of a steel plate which can overcome the above-described problems.

The present invention provides a method for the electrolytic tin plating of a steel plate using an insoluble anode, wherein the anode is an insoluble electrode comprising a corrosion-resistant metal substrate having provided thereon a coating containing a platinum group metal or an oxide thereof and the anode is enclosed with a diaphragm.

By this method, the above-described conventional drawbacks are minimized, so that it becomes possible to effectively attain a reduction in the amount of plating-bath ingredients used and an improvement in the quality of plated products obtained. In addition to this, electrolytic tin plating can be conducted efficiently in a stable manner over a prolonged period of time, because the insoluble electrode used in the present invention has a long lifetime and enables the electroplating to be conducted at an increased current density, and because formation of tin oxide sludges and deposition thereof on the electrode surface can be prevented by enclosing the insoluble electrode with a diaphragm.

DETAILED DESCRIPTION OF THE INVENTION

The electrolytic tin plating method for a steel plate according to the present invention can be conducted using an electrolytic bath conventionally used for the ferro-stann method or the like and a vertical electrolytic cell for continuous plating. However, any of similar electrolytic baths of various kinds can also be used, and the method can also be applied to electroplating techniques using other kinds of plating tanks, including the horizontal type, radial type, etc.

The characteristic feature of the plating method in accordance with the present invention resides in that an insoluble electrode having a coating containing a platinum group metal or an oxide thereof is used as the anode and that electroplating is conducted with this electrode being partitioned off by enclosing it with a diaphragm.

The insoluble electrode comprises a substrate made of a corrosion-resistant metal, such as titanium, tantalum, niobium, etc., and has formed thereon a coating containing a platinum group metal, such as platinum, iridium, rhodium, etc., as a coating ingredient. The platinum group metal contained in the coating is in the form of metal, an oxide, a mixture thereof, or a mixture with other coating ingredient(s) such as oxides of Ti, Ta, Nb, Sn and the like. The insoluble electrode includes various kinds of electrodes known as oxygen-evolving electrodes. Although platinum-coated electrodes can be used, use of an insoluble electrode having formed thereon a coating comprising as a main component an oxide of a platinum group metal such as iridium, rhodium, etc., is preferred in that such an insoluble electrode has a longer lifetime than the platinum-coated electrodes and shows an anode voltage about 0.5 V lower than that of the platinum-coated electrodes, thereby attaining long-term stable operation at a high current density and producing the effect of reducing power consumption due to the lowered cell voltage.

Such an insoluble electrode is enclosed as an anode with a diaphragm, usually in the form of a bag, and is used in a plating tank to conduct electroplating, with the enclosed insoluble electrode being partitioned off as the anode chamber. As the anode solution, for example, a sulfuric acid aqueous solution having a concentration of about 0.5 to 30% is used. Thus, by separating the anode from the cathode plating bath, the reactions in which $Sn^{2+}$ present in the plating bath is oxidized around the anode to $Sn^{4+}$, which in turn yields $SnO_2$ sludges, can be prevented. Use of the enclosed insoluble electrode also has the effect of eliminating the problem of $Sn^{4+}$ accumulating in the plating bath to impair the quality of tin-plated products. As the diaphragm, any diaphragms, such as ion-exchange membranes, neutral resin membranes, and the like can be used so long as they have good electrical conductivity and can prevent the solutions from mingling with each other or passing therethrough. Preferred of these is a diaphragm which can prevent the permeation therethrough of ingredients added to the plating bath.

These membranes are prepared with perfluoro polymers, vinylchloride polymer, styrene-divinylbenzene copolymers, methyl methacrylate-divinylbenzene copolymers and others.

Neutral resin membranes with high porosity act merely as a barrier, slowing down the transport of the plating solution to the anode chamber.

Ion-exchange membranes are highly ion-selective, permitting the transport of either cations and anions.

The cation exchange membranes are substituted with sulphonic and/or calboxylic groups while the anion exchange membranes are substituted with quaternary ammonium groups.

These membranes can prevent the transport of Sn(II) ion and ingredients in the plating solution to the anode chamber.

As described above, formation of tin oxide sludges and deposition thereof on the anode surface are effectively prevented by enclosing the insoluble anode with a diaphragm to partition it off. Thus, the conventional problems of voltage increase and electrode deactivation due to sludge deposition can be eliminated. In addition to this, it has also become possible to greatly reduce the consumed amount of ingredients added to the plating bath, such as PSA, ENSA, etc., as described hereinabove, because such ingredients are prevented from undergoing anode oxidization or being oxidatively decomposed by a nascent oxygen generated at the anode.

The present invention is explained below in more detail by reference to the following Example, which is not to be construed as limiting the scope of the invention.

EXAMPLE

Using an insoluble electrode as the anode obtained by covering a titanium plate having a size of 50 mm by 100 mm and a thickness of 2 mm with a mixed oxide coating containing an iridium oxide and a tantalum oxide, and also using as the cathode a steel plate having the same size as the insoluble electrode, electrolytic tin plating was conducted at an anode-cathode distance of 50 mm, a current density of 30 A/dm$^2$, and a temperature of about 45° C.

The anode had been enclosed with an ion-exchange membrane (trade mark, Nafion 117, manufactured by du Pon't) or a neutral resin membrane (trade mark, Yumicron Y9205, manufactured by Yuasa Battery) in the form of bag, and 20 g/l $H_2SO_4$ solution was used as the anode solution while circulating. As the cathode-solution electrolytic bath, a solution containing 15 g/l PSA, 5 g/l ENSA, 30 g/l $Sn^{2+}$, and 0.3 g/l $Sn^{4+}$ was used while being circulated. The consumed amounts of PSA and ENSA and the accumulated amount of $Sn^{4+}$ were measured.

As plating proceeded, the cathode was replaced with a fresh cathode at intervals of one hour. Thus, electroplating was conducted for 20 hours. The results obtained are shown in Table 1. For the purpose of comparison, an electroplating was conducted as described above except that a platinum-plated titanium electrode was used as the anode without using a diaphragm. The results obtained are also shown in Table 1.

TABLE 1

| Run No | Anode | Diaphragm | Consumed amount of bath ingredient (%) PSA | ENSA | Accumulated amount of $Sn^{4+}$ (g/l) |
|---|---|---|---|---|---|
| 1 | Insoluble electrode | Ion-exchange membrane | 3 | 1 | 0.3 |
| 2 | Insoluble electrode | Neutral membrane | 4 | 1 | 0.4 |
| Comparative Example | Pt/Ti | None | 16 | 4 | 1.5 |

It is clear from the results shown in Table 1 that according to the method of the present invention, the consumed amount of electrolytic-bath ingredients can be reduced greatly and the accumulation of $Sn^{4+}$ is negligible, as compared with the conventional method using no diaphragm. It was also ascertained that in the electroplating according to the present invention, deposition of tin oxide sludges on the anode does not occur; hence, high-quality electrolytic tin plating can be conducted efficiently in a a stable manner over a prolonged period of time.

As described above, since the electrolytic tin plating of a steel plate according to the present invention is conducted using an insoluble electrode as the anode, with the insoluble electrode being enclosed with a diaphragm, the consumption of electrolytic-bath ingredients due to anode oxidization, etc., can be reduced greatly, and, in addition, the formation of tin oxide sludges and deposition thereof on the anode surface can be effectively prevented. Therefore, even at high current densities, electrolytic tin plating can be conducted efficiently in a stable manner over a prolonged period of time.

While the invention has been described in detail and with reference to specific embodiments thereof, it will be apparent to one skilled in the art that various changes and modifications can be made therein without departing from the spirit and scope thereof.

What is claimed is:

1. A method for the electrolytic tin plating of a steel plate using a steel plate as a cathode to be plated, a cathode plating bath containing $Sn^{+2}$, and an insoluble anode separated from said cathode plating bath, said anode being an insoluble electrode comprising a corrosion-resistant metal substrate having provided thereon a coating containing a platinum group metal or an oxide thereof, and said anode being enclosed with a diaphragm which prevents the transport of Sn(II) ions and ingredients in the plating solution to the anode chamber, whereby the formation of tin oxide sludges and deposition thereof on the anode surface are effectively prevented and the consumption of ingredients added to the plating bath is decreased.

2. A method as in claim 1, wherein the diaphragm is an ion-exchange membrane or a neutral membrane.

3. A method as in claim 1, wherein said coating consists essentially of a platinum group metal oxide.

4. A method as in claim 1, wherein said diaphragm is in the form of a bag.

* * * * *